US009017126B2

(12) United States Patent
Newmann

(10) Patent No.: US 9,017,126 B2
(45) Date of Patent: Apr. 28, 2015

(54) CONVERTIBLE EMERGENCY DEVICE

(71) Applicant: Paul Patrick Newmann, New York, NY (US)

(72) Inventor: Paul Patrick Newmann, New York, NY (US)

( * ) Notice: Subject to any disclaimer, the term of this patent is extended or adjusted under 35 U.S.C. 154(b) by 0 days.

(21) Appl. No.: 14/170,591

(22) Filed: Feb. 1, 2014

(65) Prior Publication Data

US 2014/0148070 A1 May 29, 2014

Related U.S. Application Data

(63) Continuation-in-part of application No. 13/368,283, filed on Feb. 7, 2012, now abandoned.

(51) Int. Cl.

| | |
|---|---|
| ***B63C 9/23*** | (2006.01) |
| ***B63C 9/13*** | (2006.01) |
| ***B63C 9/15*** | (2006.01) |

(52) U.S. Cl.

CPC ... *B63C 9/23* (2013.01); *B63C 9/13* (2013.01); *B63C 9/155* (2013.01)

(58) Field of Classification Search

CPC ..... B63C 9/1255; B63C 9/155
USPC ..... 441/118, 92
See application file for complete search history.

(56) References Cited

U.S. PATENT DOCUMENTS

| | | | | |
|---|---|---|---|---|
| 2,114,301 | A * | 4/1938 | Harrigan | 244/148 |
| 2,467,037 | A * | 4/1949 | Kajdan | 244/148 |
| 2,784,426 | A * | 3/1957 | Boyle et al. | 441/111 |
| 4,645,465 | A * | 2/1987 | Courtney | 441/40 |
| 4,681,552 | A * | 7/1987 | Courtney | 441/92 |
| 4,810,217 | A * | 3/1989 | Bell | 440/13 |
| 5,393,254 | A * | 2/1995 | Ducheshe | 441/118 |
| 5,516,233 | A * | 5/1996 | Courtney | 405/186 |
| 5,855,454 | A * | 1/1999 | Courtney et al. | 405/186 |
| 6,036,562 | A * | 3/2000 | Brown | 441/108 |
| 6,173,671 | B1 * | 1/2001 | Casull | 114/345 |
| 6,394,866 | B1 * | 5/2002 | Brown | 441/108 |
| 6,394,867 | B1 * | 5/2002 | Bianco | 441/126 |
| 6,551,161 | B2 * | 4/2003 | Chern et al. | 441/124 |
| D475,149 | S * | 5/2003 | Chun | D26/37 |
| 7,305,715 | B2 * | 12/2007 | Orsos | 2/67 |
| 8,231,421 | B1 * | 7/2012 | Hubbard et al. | 441/92 |
| 8,371,886 | B1 * | 2/2013 | Strangfeld | 440/101 |
| 2013/0203310 | A1 * | 8/2013 | Newman | 441/92 |

* cited by examiner

*Primary Examiner* — Lars A Olson
*Assistant Examiner* — Jovon Hayes
(74) *Attorney, Agent, or Firm* — The Keys Law Firm PLLC

(57) ABSTRACT

A convertible emergency device for enabling a user to deploy a floatation device from a wearable structure in an emergency situation. The convertible emergency device comprises in one embodiment waist pack which can convert to an inflated life vest by actuation of a pull cord. Such actuation of the pull cord causes portions of the body of the waist pack to automatically inflate with air from a gas cylinder canister. The convertible emergency device comprises in another embodiment a backpack configured to convert into an inflatable life boat having a pair of oars. When in the backpack state, the uninflated life boat is releasably attached to the shoulder strap and the oars, with the pair of oars disposed on the either side of the uninflated life boat. When a pull cord is pulled, the life boat is inflated to enable it to provide a floating vessel for a user.

4 Claims, 4 Drawing Sheets

CONVERTIBLE EMERGENCY DEVICE

CROSS REFERENCE TO RELATED APPLICATIONS

This application is a continuation in part of, claims the benefit of, and incorporates by reference co-pending U.S. patent application Ser. No. 13/368,283, filed Feb. 7, 2012.

BACKGROUND OF THE INVENTION

1. Field of the Invention

This invention relates generally to emergency supplies and, more particularly, to a convertible emergency supplies which are adapted to be carried in an storage state and converted into a deployed state when needed.

2. Description of the Prior Art

The use of emergency supplies for survival in disaster or emergency situations is well known. Indeed, the chances for survival for anyone who becomes stranded at sea are greatly increased if some type of floatation device is available for use. A problem which still exists, however, is that many floatation devices are unable to be conveniently transported on the person of a would be user. If a would be user is not able to access or did not put on a floatation device before actually needing it, it is common for them to become stranded without one. Thus, there remains a need for a convertible emergency device which is wearable and convertible into a floatation device when needed. It would be helpful if such a convertible emergency device could be embodied as a waist pack. It would be additionally desirable is such a convertible emergency device could be embodied as a back pack.

The Applicant's invention described herein provides for a convertible emergency device embodied as a waist pack or a back pack which can provide a floatation means. The primary components of Applicant's convertible emergency device are a wearable base, a replaceable gas cylinder, and a pull cord. When in operation, the convertible emergency device allows a user to convert a wearable structure from a storage state into a floatation device in a deployed state at the time of use. As a result, many of the limitations imposed by the prior art structures are removed.

SUMMARY OF THE INVENTION

A convertible emergency device for enabling a user to deploy a floatation device from a wearable structure in an emergency situation. The convertible emergency device comprises in one embodiment waist pack which can convert to an inflated life vest by actuation of a pull cord. Such actuation of the pull cord causes portions of the body of the waist pack to automatically inflate with air from a gas cylinder canister. The convertible emergency device comprises in another embodiment a backpack configured to convert into an inflatable life boat having a pair of oars. The backpack includes a shoulder strap which is adapted to enable a user to wear the backpack over a shoulder. When in the backpack state, the uninflated life boat is releasably attached to the shoulder strap and the oars, with the pair of oars disposed on the either side of the uninflated life boat. When a pull cord is pulled a gas cylinder canister is used to inflate the life boat enabling it to provide a floating vessel for a user.

It is an object of this invention to provide a convertible emergency device which is wearable and convertible into a floatation device when needed.

It is another object of this invention to provide a convertible emergency device embodied as a waist pack.

It is yet another object of this invention to provide a convertible emergency device embodied as a back pack.

These and other objects will be apparent to one of skill in the art.

DETAILED DESCRIPTION OF THE INVENTION

Figure 1A:
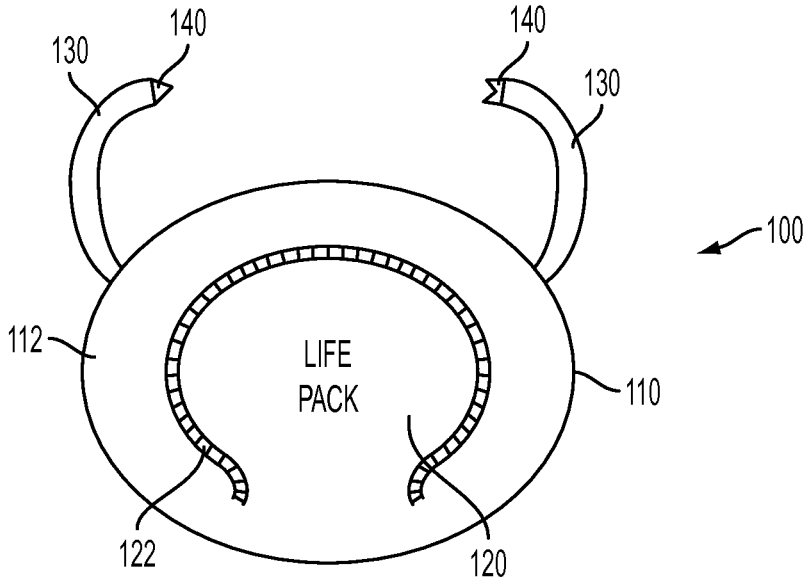
FIG. 1*a* is a front elevational view of a waist pack of a convertible emergency device built in accordance with a first embodiment of the present invention.

Referring now to the drawings and in particular FIG. 1*a*, the convertible emergency device 100 is shown as a waist pack 110 with pack body 112, an interior portion 120, a pair of straps 130 and a pair of snaps 140. The waist pack 110 defines the convertible emergency device 100 in its storage state. The waist pack 110 includes a zipper 124 disposed around the perimeter on the interior portion 120. The zipper 124 provides selective access to a pull cord inside the interior portion 120, which enables the waist pack 110 to be inflated. By unzipping the zipper 124, the contents of the interior portion can be folded out. The straps 130 are each configured to extend from the pack body 112 to enable them to wrap around and secure the convertible emergency device 100 around a user's waist. One snap 140 is disposed on the terminal end of each of the straps 130. The snaps 140 are defined as interlocking fasteners which enable the straps 130 to be fastened in place around the waist of a user.

Figure 1B:
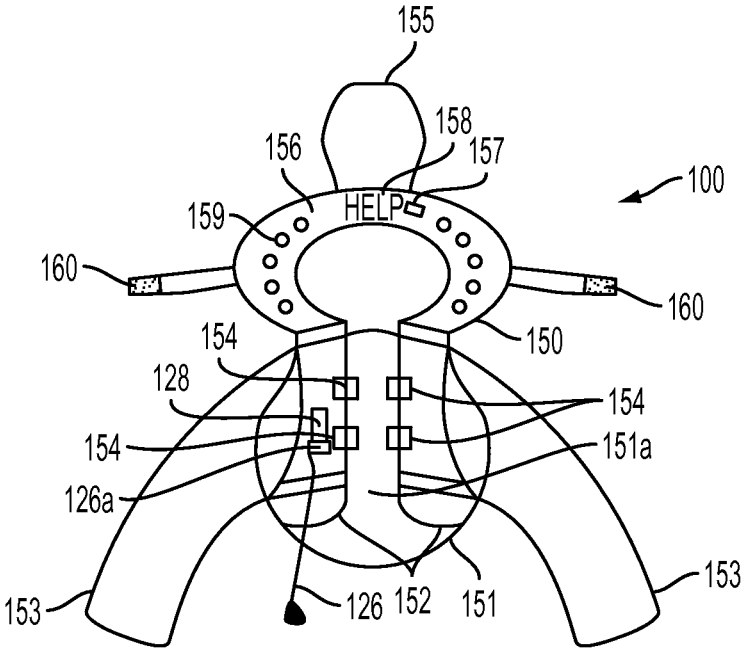
FIG. 1*b* is a front elevational view of a life vest of a convertible emergency device built in accordance with a second embodiment of the present invention.

Referring now to FIGS. 1*a* and 1*b*, the convertible emergency device 100 is shown as an inflated life vest 150 is formed from the waist pack 110. The waist pack 110 is converted into the life vest 150 by first unzipping the zipper 122 and folding down the vest body 151. Once the vest body 151 is folded down, a pull cord 126 can be pulled to cause a gas cylinder cartridge 128 to inflate the life vest 150. The inflated life vest 150 includes two vest sides 152 that can be secured together around a user with one or more hook and loop fasteners 154 across a user's chest and a vest back 151*a* configured to contact a user's back, enabling the inflated life vest 150 to be secured around the upper body of a user.

Once the vest body 151 is folded down, the pack body 112 becomes an open ring portion 156 configured to be wrapped around a user's neck. The open ring portion 156 includes reflective indicia 158 such as the word "HELP" or other suitable reflective indicia such as the acronym "SOS," a solar powered GPS device 157, and a plurality of solar powered LED lights 159 that are disposed on the open ring portion 156 to possibly indicate to surrounding persons the user's need for help. The inflated life vest 150 includes a pair of sleeves 153 and a hood 155 to enable a user to cover his arms and head and be protected from the sun. It is contemplated, however, that the sleeves 153 and hood 155 are not inflated with the other components of the life vest. In addition, the inflated life vest 150 includes a pair of vest adjoining straps 160 which include a hook and loop fastener surface and enable the inflated life vest 150 to be attached to another inflated life vest built in accordance with the present invention or with a life boat built in accordance with the present invention. In this regard, a plurality of life vests 150 may be releasably attached together or to life boats in an emergency situation to prevent someone from getting lost or otherwise separated from a group.

It is additionally contemplated that the pull cord 126 is configured to engage a gas actuator 126*a* to which the gas cylinder cartridge 128 is connected in order to release the gas in the gas cylinder cartridge 128 to cause the life vest 150 to inflate. In the preferred embodiment, the gas cylinder cartridge 128 is removable and replaceable with another gas cylinder cartridge 128 as desired by a user, with each gas cylinder cartridge 128 having 25 grams of compressed air. In the preferred embodiment, the life vest 150 has 35 pounds of buoyancy.

Figure 2A:
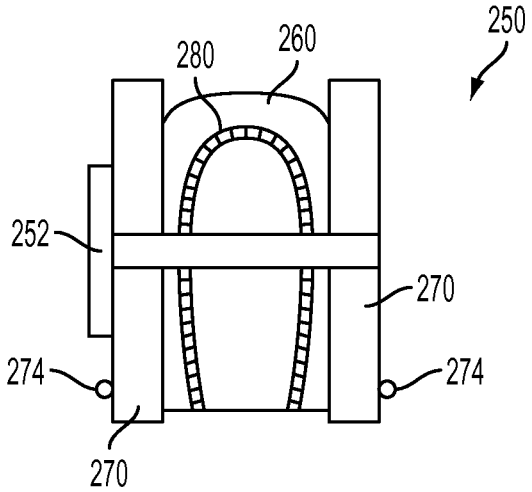
FIG. 2*a* is a front elevational view of a backpack of a convertible emergency device built in accordance with a second embodiment of the present invention in a closed position.
Figure 2B:
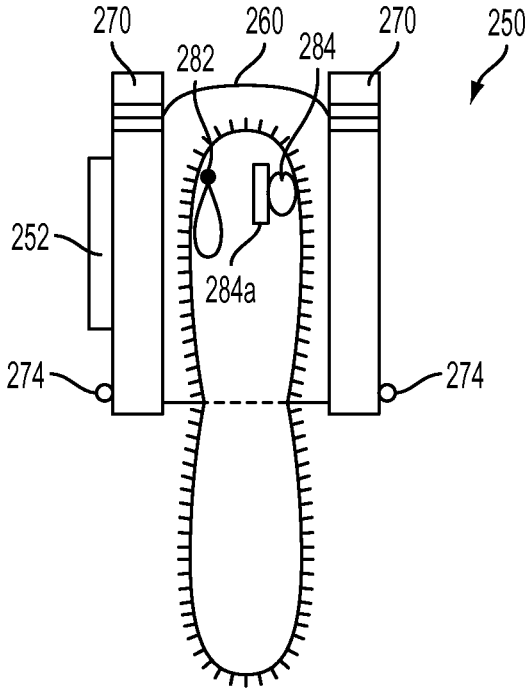
FIG. 2*b* is a front elevational view of a backpack of a convertible emergency device built in accordance with a second embodiment of the present invention in an open position.
Figure 2C:
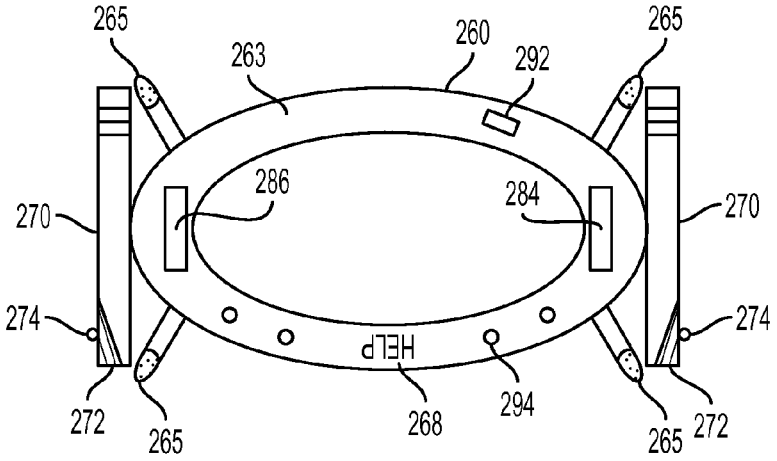
FIG. 2*c* is a side perspective view of a floatable raft of a convertible emergency device built in accordance with a second embodiment of the present invention.
Figure 2D:
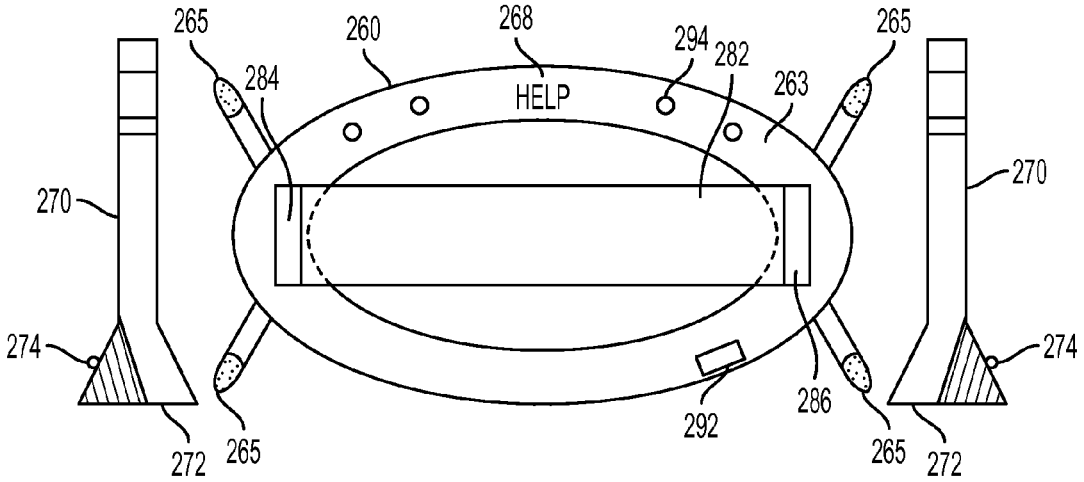
FIG. 2*d* is a reverse side perspective view of a floatable raft of a convertible emergency device built in accordance with a second embodiment of the present invention.

Referring now to FIGS. 2*a* and 2*b*, a backpack 250 is shown with a front 252 and includes an inflatable life boat 260, a pair of oars 270 and a zipper 280. The front 252 is defined by a shoulder strap which is adapted to enable a user to wear the backpack 250 over a shoulder. The inflatable life boat 260 is releasably attached to the front 252 and the oars 270 through a strap 254. The pair of oars 270 are disposed on the either side of the inflatable life boat 260 and are in an unextended position when forming the backpack 250. The oars are attached to the inflatable life boat 260 through a hook and loop fastening system. A zipper 280 is additionally disposed on the life boat 260. The zipper 280 can be opened to access a pull cord 282, which can be manually engaged enable a user to inflate the inflatable life boat 260.

Referring now to FIGS. 2*a*, 2*b*, 2*c*, and 2*d*, when the pull cord 282 is pulled, an gas cylinder canister 284 which is attached to a gas actuator 284*a* causes the life boat 260 to inflate with air. In the preferred embodiment, the gas cylinder canister 284 contains 80 grams of compressed air. When inflated, the inflatable life boat 260 has a top perimeter 263 with one or more reflective indicia 268, such as the word "HELP" disposed thereon. Additional reflective indicia such as the words "SOS" or "NEED RESCUE" can also be disposed elsewhere on the inflatable life boat 260. The inflatable life boat 260 accommodates 1 to 4 people when expanded and inflated and has a buoyancy of 45 pounds. The oars 270 detach from the inflated life boat 260 and can be used to move the inflated life boat 260 in water. In the preferred embodiment, the oars are telescoping and adjustable in length and the distal ends 272 can also be expanded in width to form a general fan shape through a spring loaded fan mechanism which is actuated by a fan actuator 274. Typically the distal ends 272 are kept in the storage position while the oars 270 are stored and fanned out when utilized in the water.

The inflated life boat 260 includes a pair of boat adjoining straps 265 which include a hook and loop fastener surface and enable the inflated life boat 260 to be attached to an inflated life vest built in accordance with the present invention or with another life boat built in accordance with the present invention. In this regard, a plurality of life boats 260 may be releasably attached together or two one or more life vests in an emergency situation to prevent someone from getting lost or otherwise separated from a group A retractable cover 282 may be extended over a portion of the life boat 260. The retractable cover 282 extends from a cover housing 284 to a cover dock 286, and when extended, is fastened to the cover dock 286 through a hook and loop fastener system. In this regard the retractable cover enables provides cover and protection for users in the inflated life boat 260 from sunlight and UV rays from the sun.

The inflatable life boat 260 also includes a solar powered GPS device 292 and a plurality of solar powered LED lights 294. The solar powered GPS device 292 is disposed on any suitable area of the inflated life boat 260 and is utilized to track the location thereof. The solar powered LED lights 294 are disposed on any suitable area of the inflated life boat 260 as well and are utilized to illuminate the inflatable life boat 260.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A convertible emergency device, comprising:

a discrete backpack which includes a front portion removably attached to an inflatable life boat and a pair of detachable oars, wherein said backpack contains a boat actuator defined as a pull cord which causes the backpack to inflate into an inflatable life boat when manually actuated;

a gas cylinder cartridge having compressed air therein, wherein said gas cylinder cartridge is configured to inflate the life boat; and said oars include a fanning distal end which enables the width of said distal end to be selectively increased through a spring loaded fan mechanism which is actuated by a fan actuator.

2. The convertible emergency device of claim 1, additionally comprising a retractable cover adapted to cover a portion of the life boat when inflated.

3. The convertible emergency device of claim 1, wherein the oars include a telescoping body which enables them to selectively increase and decrease in length.

4. The convertible emergency device of claim 1, wherein said life boat includes at least one boat adjoining strap adapted to enable a plurality of life boats to be releasably attached together.

* * * * *